United States Patent [19]

Jaegle et al.

[11] 4,020,434

[45] Apr. 26, 1977

[54] POLARIZED ELECTROMAGNETIC RELAY AND METHOD OF MANUFACTURING THE SAME

[75] Inventors: Bruno Jaegle, Munich; Gerhard Furtwaengler, Unterhaching, both of Germany

[73] Assignee: Siemens Aktiengesellschaft, Berlin & Munich, Germany

[22] Filed: Jan. 23, 1976

[21] Appl. No.: 651,912

[30] Foreign Application Priority Data

Jan. 27, 1975 Germany ..... 2503159

[52] U.S. Cl. ..... 335/230; 335/78; 335/179; 335/274

[51] Int. Cl.[2] ..... H01H 51/22

[58] Field of Search ..... 335/230, 229, 232, 233, 335/234, 236, 237, 78, 79, 80, 84, 85, 86, 136, 137, 170, 179, 180, 181, 182, 183, 273, 274, 275, 276; 29/622

[56] References Cited

UNITED STATES PATENTS

| | | | |
|---|---|---|---|
| 3,195,023 | 7/1965 | Ueberschuss et al. | 335/230 |
| 3,317,871 | 5/1967 | Adams | 335/230 |
| 3,621,419 | 11/1971 | Adams et al. | 335/170 |
| 3,775,715 | 11/1973 | Bosch et al. | 335/234 |

*Primary Examiner*—Harold Broome
*Attorney, Agent, or Firm*—Hill, Gross, Simpson, Van Santen, Steadman, Chiara & Simpson

[57] ABSTRACT

A polarized electromagnetic relay includes an operating winding on a core and a two-legged pivotal armature whose first leg forms a first working air gap with one pole of the winding and whose second leg forms a second working air gap with an angular yoke. A permanent magnet is arranged parallel to the operating winding and provides a magnetic flux which is closed partially by way of the first armature leg and the first working air gap and partially by way of the second armature leg and the second working air gap. The armature is pivotally supported on a yoke plate which extends parallel to the operating winding and in alignment with and separated from a leg of the angular yoke. The angular yoke and the yoke plate each include a flat surface portion for mounting opposite end portions of the permanent magnet.

14 Claims, 3 Drawing Figures

POLARIZED ELECTROMAGNETIC RELAY AND METHOD OF MANUFACTURING THE SAME

BACKGROUND OF THE INVENTION

1. Field of the Invention

This invention relates to a polarized electromagnetic relay and a method of manufacturing the same, and is particularly concerned with a polarized magnetic relay having an operating winding and a two-legged pivotal armature whose first leg forms a first working air gap with a pole of the core of the operating winding and whose second leg forms a second working air gap with an angular yoke, and in which a permanent magnet is arranged parallel to the operating winding and provides a magnetic flux which is closed partially by way of the first armature leg and the first working air gap and partially by way of the second armature leg and the second working air gap.

2. Description of the Prior Art

A relay of the type generally mentioned above is well known in the art, for example, reference may be taken to the German Letters Pat. No. 846,863. However, in the case of this known construction, the permanent magnet is arranged between the cross beam of the yoke and a support plate so that the manufacturing tolerances of all of these parts are additive. Such a structure, therefore, suffers from the drawback that the manufacturing tolerances influence the working air gap between the armature and the core without an adjustment being possible during assembly.

SUMMARY OF THE INVENTION

It is the primary object of the present invention to improve the magnetic system for a relay of the type mentioned above and to thereby avoid the disadvantages concerning the deleterious effect of the tolerances on the working air gap.

A more specific object is to provide a polarized flat-type relay which is simple to fabricate, and which makes possible a precise adjustment of the working air gap during fabrication, independent of the tolerances of the individual parts.

According to the invention, the foregoing objectives are achieved by supporting the armature when a yoke plate which is arranged parallel to the operating winding and in alignment with and spaced from a leg of an angular yoke. The angular yoke and the yoke plate each have flat surface portions for mounting the polarizing permanent magnet.

Due to a lateral mounting of the permanent magnet to the yoke parts, as opposed to an aligned mounting, the length of tolerances of the individual elements make no difference as far as the working air gap is concerned. The first working air gap can be adjusted during fabrication by bringing the yoke plate with the armature support into the desired position and by securing the same in the desired position by means of the lateral mounting of the permanent magnet. The permanent magnet can be mounted according to a known method, for example, through adhesion. It is expedient to arrange the permanent magnet between the angular yoke and the yoke plate on the one side, and the operating winding on the other side. The permanent magnet therefore lies opposite the second armature leg.

In an advantageous further development of the invention, it is provided that the angular yoke and the yoke plate be additionally connected by means of an intermediate member which consists of non-ferromagnetic material. The permanent magnet is thereby relieved of the burden of mechanical stress between the yoke parts. An intermediate plate of this type may consist, for example, of nickel-silver or a similar material of low magnetic permeability. This intermediate plate is expediently welded to the angular yoke and to the yoke plate. In so doing, it is advantageous to provide a recess in the angular yoke and in the yoke plate which is greater than or equal to the thickness of the intermediate plate. The permanent magnet then acquires an unmistakable support bearing on the yoke parts; the gap between the magnet and the intermediate plate can be filled by an adhesive material so that the intermediate plate contributes to the mounting support for the permanent magnet.

A relay constructed according to the present invention can be complemented with a varying number of contacts, since the permanent magnet, and thus the operating values, can be simply adapted to the particular requirements. For this purpose, the permanent magnet is initially magnetized up to a maximum value, and, subsequent to assembly, the magnetic field of the magnet is weakened by a counter energization, which counter energization increases as the number of contact springs to be activated decreases. The counter energization can take place simply by reaching the yoke plate and the armature on the one side and the angular yoke on the other side between two magnetic poles whose polarization is directed opposite to that of the permanent magnet. An adjustment of the magnetic system can also be carried out by applying a constant magnetic field transversely to the permanent magnet which is polarized in its longitudinal direction. In this case, the distance of the demagnetization poles can be smaller than in the first instance. The demagnetization energy required thus becomes smaller.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
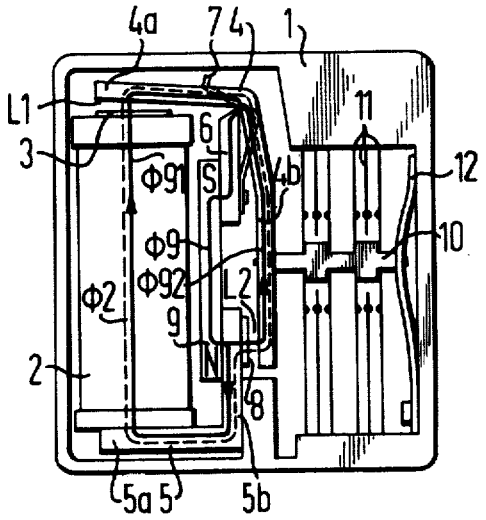
FIG. 1 is an elevational view of a polarized relay constructed in accordance with the principles of the present invention.

FIG. 1 illustrates, in an elevational view, a flat-type relay constructed according to the invention. The entire magnetic system and the contacts of the relay are placed in a base member 1 which can have a plate-shaped or box-shaped construction. The magnetic system comprises an operating winding 2 which is disposed about a core 3 and which, together with a first armature leg 4*a* of an armature 4 forms a first working air gap L1. The opposite end of the core 3 is connected to an angular yoke 5 by means of a leg 5*a*, while a second leg 5*b* stands parallel to the longitudinal axis of the operating winding. A yoke plate 6 is arranged in longitudinal alignment with and spaced from the leg 5*b* of the angular yoke 5. The yoke plate 6 includes a knife-edge support, at its upper end as viewed in FIG. 1, for the armature 4. The armature 4 is urged toward the knife-edge support by an armature spring 7 which is connected to the yoke plate 6. The second armature leg 4*b* forms a second working air gap L2 with the leg 5*b* of the angular yoke 5. Sticking of the armature is prevented in a conventional manner by means of a separating sheet 8.

The angular yoke 5 is connected to the yoke plate 6 by means of a permanent magnet 9, which is disposed laterally of the alignment of the parts 5 and 6 and which is poled in the direction of the axis of the operating winding. The flux $\phi 9$ of the permanent magnet 9 is divided into a first flux portion $\phi$ 91 and a second flux portion $\phi$ 92. The flux portion $\phi$ 91 closes over a path including the first armature leg 4*a*, the first working air gap L1, the core 3, and the angular yoke 5, while the second flux portion $\phi$ 92 closes by way of the second armature leg 4*b* and the second working air gap L2. The exciting flux $\phi$ 2 closes over both armature legs 4*a* and 4*b*, as well as over both working air gaps L1 and L2, whereby, depending upon the direction of the exciting current, it is reinforced by the flux of the permanent magnet in one working air gap and is opposed by the flux of the permanent magnet in the other working air gap. Accordingly, one of the armature legs 4*a* and 4*b* is attracted and pulled up. As soon as the armature has been brought into one of the two possible positions, it continues to stay in the assumed position, since a greater portion of the flux of the permanent magnet then flows over the closed working air gap, securely holding the corresponding armature leg in place.

The arrangement of the permanent magnet 9 laterally of the alignment of the yoke elements 5 and 6 makes possible a precise adjustment of the working air gap L1 during fabrication of the relay, independent of the mass tolerances of the permanent magnet and the yoke parts. In order to accomplish this, the leg 5*b* of the angular yoke 5 need only be aligned on a flat plane with the yoke plate 6, whereby the air gap L1 can be adjusted by means of changing the distance between the leg 5*b* and the yoke plate 6. The permanent magnet 9 is then bonded onto the flat surfaces of the parts 5 and 6. After the adhesive has hardened, the angular yoke 5 is firmly connected to the yoke plate 6.

In addition, it should be noted that the armature leg 4b activates a desired number of spring contacts 11 by way of an armature follower 10 in a well known manner. The contact springs 11 may, for example, be anchored in the base member 1. A restoring spring 12 serves the purpose of equalizing forces and guiding the armature follower 10.

Figure 2:
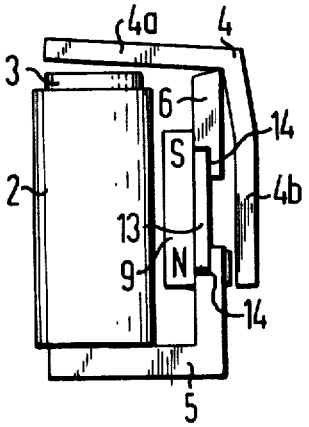
FIG. 2 is an elevational view of a further development of the magnetic system of a relay constructed according to the present invention.

FIG. 2 illustrates a somewhat altered embodiment on the magnetic system illustrated in FIG. 1. In FIG. 2, however, the yoke plate 6 is connected to the angular yoke 5 not only through the permanent magnet 9, but by way of the non-magnetic plate 13 which is provided as an additional connecting component. The connection is thereby made more stable and, above all, the permanent magnet is relieved of mechanical stresses, in contrast to the structure of FIG. 1. Advantageously, the assembly is carried out such that the angular yoke 5 and the yoke plate 6 are aligned in a device as described above, whereby the working air gap L1 is also adjusted. Then, the non-magnetic intermediate plate 13 is applied by means of electro-welding techniques, and, finally, the permanent magnet 9 is bonded to the intermediate plate 13, the angular yoke 5 and the yoke plate 6. In order to provide a planar contact surface for the permanent magnet 9, the angular yoke 5 and the yoke plate 6 are each provided with a recess 14 which corresponds to the thickness of the plate 13. As mentioned above, the recesses 14 can be greater than the thickness of the plate 13 and the space between the plate 13 and the magnet 9 may be filled with an adhesive material. The remaining construction of the magnetic system is the same as illustrated in FIG. 1.

Figure 3:
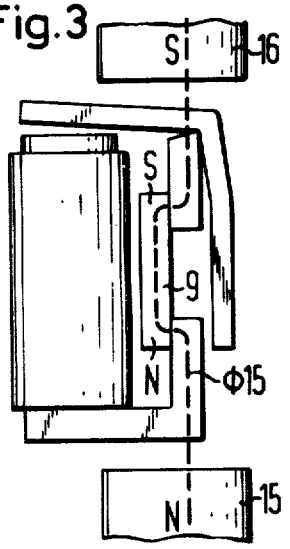
FIG. 3 is an elevational view of an arrangement of the magnetic system according to the invention undergoing an adjusting force for the permanent magnet.

Turning now to FIG. 3, a magnetic adjustment for a relay constructed according to FIG. 1 or FIG. 2 is illustrated. A magnetic adjustment makes it possible to complement a relay with a varying number of contacts, and to adjust the triggering excitation of the relay to the number of contacts. In this case, the permanent magnet 9 is first magnetized up to a maximum value, and adjustment takes place by means of a directed demagnetization of the permanent magnet 9. For this purpose, the magnetic system is brought into a constant demagnetizing field, which is represented by the two magnetic poles 15 and 16. Thus, the magnetic poles 15 and 16 produce a magnetic flux $\phi$ 15 which is opposite to the direction of polarization of the permanent magnet 9. The magnetic strength of the permanent magnet 9 is then weakened in accordance with the strength of the demagnetization flux $\phi$ 15.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a polarized relay of the type having an operating winding on a core, a two-legged pivotal armature whose first leg forms a first working air gap with one pole of the operating winding and whose second leg forms a second working air gap with an angular yoke, and a permanent magnet arranged parallel to the operating winding and whose magnetic flux is closed partially through the first armature leg and the first working air gap and partially through the second armature leg and the second working air gap, the improvement comprising:

a yoke plate pivotally supporting said armature, the angular yoke including a portion aligned with and separated from said yoke plate, said yoke plate and said portion of the angular yoke extending parallel to the operating winding, said yoke plate and said portion of the angular yoke each including a flat surface parallel to the operating winding, the permanent magnet mounted on said flat surfaces.

2. The improved polarized relay of claim 1, wherein said flat surfaces face the operating winding and mount the permanent magnet between said portion of the angular yoke and said yoke plate on one side and the operating winding on the other side.

3. The improved polarized relay of claim 1, wherein the improvement further comprises:

an intermediate plate of non-ferromagnetic material connecting said yoke plate and said portion of the angular yoke.

4. The improved polarized relay of claim 3, wherein said portion of the angular yoke and said yoke plate each include recessed portions receiving said intermediate plate.

5. The improved polarized relay of claim 3, wherein said intermediate plate at least partially supports the permanent magnet.

6. A polarized relay comprising:

an elongate core having first and second ends and an operating winding carried about said core;

a yoke plate extending parallel to said operating winding;

an armature pivotally carried by said yoke plate, said armature including first and second legs, said first armature leg extending over said first end of said core to define a first working air gap therebetween;

an angular yoke including a first yoke portion extending parallel to said operating winding and spaced from and in alignment with said yoke plate, said first yoke portion also spaced from said second armature leg to define a second working air gap therebetween, and a second yoke portion connected to said second end of said core; and an elongate permanent magnet extending parallel to said operating winding and having opposite end portions which respectively overlap and are connected to said yoke plate and said first yoke portion.

7. A polarized relay according to claim 6, comprising;

an intermediate member of non-magnetic material connecting said first yoke portion and said yoke plate.

8. A polarized relay according to claim 7, wherein said yoke plate and said first yoke portion each includes a recess receiving said intermediate member.

9. A polarized relay according to claim 7, wherein said permanent magnet is connected to and at least partially supported by said intermediate member.

10. A method of manufacturing a polarized relay, comprising the steps of:

mounting one leg of an L-shaped angular yoke to one end of an elongate core which has an operating winding thereon such that the other leg extends parallel to the operating winding;

aligning a yoke plate with the other leg and spaced therefrom, the yoke plate carrying an armature having a portion extending over the other end of the core to define a working air gap therebetween;

positioning a permanent magnet to overlap the yoke plate and the other leg;

moving the yoke plate with respect to the other leg to adjust the air gap; and securing the permanent magnet to the other leg and to the yoke plate.

11. The method of manufacturing a polarized relay according to claim 10, comprising the step of:

prior to securing the permanent magnet, connecting a non-magnetic member to the other leg and to the yoke plate.

12. The method of manufacturing a polarized relay according to claim 11, wherein the step of connecting the non-magnetic member is further defined as welding the non-magnetic member to the other leg and to the yoke plate.

13. The method of manufacturing a polarized relay according to claim 10, comprising the step of;

adjusting the magnetization by applying a constant magnetic field to the permanent magnet in a direction opposite to its direction of polarization.

14. The method of manufacturing a polarized relay according to claim 11, comprising the step of:

adjusting the magnetization by applying a constant magnetic field to the permanent magnet in a direction transverse to its direction of polarization.

* * * * *